US012098449B2

(12) United States Patent
Takashita et al.

(10) Patent No.: US 12,098,449 B2
(45) **Date of Patent: *Sep. 24, 2024**

(54) ALLOYED STEEL POWDER FOR POWDER METALLURGY AND IRON-BASED MIXED POWDER FOR POWDER METALLURGY

(71) Applicant: JFE STEEL CORPORATION, Tokyo (JP)

(72) Inventors: Takuya Takashita, Tokyo (JP); Nao Nasu, Tokyo (JP); Akio Kobayashi, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 139 days.

This patent is subject to a terminal disclaimer.

(21) Appl. No.: 16/978,767

(22) PCT Filed: Mar. 25, 2019

(86) PCT No.: PCT/JP2019/012562

§ 371 (c)(1),
(2) Date: Sep. 8, 2020

(87) PCT Pub. No.: WO2019/189012

PCT Pub. Date: Oct. 3, 2019

(65) Prior Publication Data

US 2021/0047713 A1 Feb. 18, 2021

(30) Foreign Application Priority Data

Mar. 26, 2018 (JP) ..... 2018-058700

(51) Int. Cl.

| | |
|---|---|
| ***C22C 33/02*** | (2006.01) |
| ***B22F 1/07*** | (2022.01) |
| ***C22C 38/12*** | (2006.01) |
| ***C22C 38/16*** | (2006.01) |
| *B22F 1/142* | (2022.01) |

(52) U.S. Cl.

CPC ..... *C22C 33/0257* (2013.01); *B22F 1/07* (2022.01); *C22C 33/02* (2013.01); *C22C 38/12* (2013.01); *C22C 38/16* (2013.01); *B22F 1/142* (2022.01); *B22F 2301/35* (2013.01); *B22F 2302/40* (2013.01); *B22F 2304/054* (2013.01)

(58) Field of Classification Search

None

See application file for complete search history.

(56) References Cited

U.S. PATENT DOCUMENTS

| | | | | |
|---|---|---|---|---|
| 3,899,368 | A | 8/1975 | Waid et al. | |
| 5,158,601 | A | 10/1992 | Fujiki et al. | |
| 5,462,577 | A * | 10/1995 | Ogura | C22C 33/02 75/255 |
| 6,068,813 | A | 5/2000 | Semel | |
| 6,607,576 | B1 | 8/2003 | Sikka et al. | |
| 6,905,530 | B2 | 6/2005 | Yoshimura et al. | |
| 8,062,584 | B2 | 11/2011 | Hamada et al. | |
| 8,734,561 | B2 | 5/2014 | Larsson | |
| 2010/0154588 | A1 | 6/2010 | Berg et al. | |
| 2013/0302202 | A1* | 11/2013 | Larsson | B22F 3/26 420/87 |
| 2016/0136727 | A1 | 5/2016 | Maetani et al. | |
| 2017/0259340 | A1 | 9/2017 | Takashita et al. | |

FOREIGN PATENT DOCUMENTS

| | | | | |
|---|---|---|---|---|
| CA | 922078 | A * | 3/1973 | B22F 9/082 |
| CN | 1297389 | A | 5/2001 | |
| CN | 1316869 | A | 10/2001 | |
| CN | 101454471 | A | 6/2009 | |
| EP | 0499392 | A2 | 8/1992 | |
| GB | 1402660 | A * | 8/1975 | C22C 33/0264 |
| JP | S5935601 | A | 2/1984 | |
| JP | 61253301 | A * | 11/1986 | |
| JP | 863235403 | A | 9/1988 | |
| JP | H104259351 | A | 9/1992 | |
| JP | H0681001 | A | 3/1994 | |
| JP | 06256802 | A * | 9/1994 | |
| JP | 06306403 | A * | 11/1994 | |
| JP | H0849047 | A | 2/1996 | |
| JP | 10237584 | A * | 9/1998 | |
| JP | 11302787 | A * | 11/1999 | |
| JP | H11302787 | A | 11/1999 | |
| JP | 2010529302 | A | 8/2010 | |
| JP | 2013508558 | A | 3/2013 | |

(Continued)

OTHER PUBLICATIONS

JP S61-253301 machine translation (Year: 1986).*
JP S59-035601 machine translation (Year: 1984).*
Jang et al. Structural changes of copper precipitates in a Cu-bearing high strength low alloy steel. Taehan Kumsok, Chaeryo, Hakhoechi (2002), 40(1), 14-20. STN abstract. (Year: 2002).*
Nakagawa et al. Effects of aging temperature on the microstructure and mechanical properties of 1.8Cu—7.3Ni—15.9Cr—1.2Mo-low C, N martensitic precipitation hardening stainless steel. Journal of Materials Science 35 (2000) 2245-2253. (Year: 2000).*
Yu et al. Study on Cu precipitate of the low C high strength steel containing Cu and Ni during isochronal tempering. Acta Metallurgica Sinica. vol. 49, No. 5. May 2013. pp. 569-575. (Year: 2013).*

(Continued)

*Primary Examiner* — Paul A Wartalowicz
*Assistant Examiner* — Stephani Hill
(74) *Attorney, Agent, or Firm* — KENJA IP LAW PC

(57) ABSTRACT

Disclosed is an alloyed steel powder for powder metallurgy from which sintered parts that do not contain expensive Ni, or Cr or Mn susceptible to oxidation, that have excellent compressibility, and that have high strength in an as-sintered state can be obtained. The alloyed steel powder for powder metallurgy has: a chemical composition containing Cu: 1.0 mass % to 8.0 mass %, with the balance being Fe and inevitable impurities; and constituent particles in which Cu is present in an precipitated state with an average particle size of 10 nm or more.

3 Claims, No Drawings

(56) References Cited

FOREIGN PATENT DOCUMENTS

| | | | |
|---|---|---|---|
| JP | 2013204112 | A | 10/2013 |
| JP | 2016156033 | A | 9/2016 |

OTHER PUBLICATIONS

Kakisawa et al. Transactions of the Materials Research Society of Japan 29[5] 1781-1784 (2004) (Year: 2004).*
Sun et al. Direct observations on the crystal structure evolution of nano Cu-precipitates in an extremely low carbon steel. Materials Letters 187 (2017) 49-52. (Year: 2017).*
Bernier et al. Copper strengthening of PM steel parts. Advances in Powder Metallurgy & Particulate Materials—2011, 2, 9-Material Properties. (Year: 2011).*
Schaeffler. Spray deposition of high-strength low-alloy steels. Electric Furnace Conference Proceedings (199), Volume Date 1989, 47, 415-430. (Year: 1989).*
Era et al. Effect of Copper Precipitation on the Development of Recrystallization Textures through Continuous Annealing of Low-Carbon Sheet Steel Metallurgical Transactions A, vol. 17A, Apr. 1986, 622-633 (Year: 1986).*
Das et al. Evolution of Microstructure in an Ultra-Low Carbon Cu Bearing HSLA Forging. Scandinavian Journal of Metallurgy 2002; 31: 272-280. (Year: 2002).*
Kakisawa et al. Effect of Consolidation Process on Tensile Properties of Fe—Cu P/M Alloy from Rapidly Solidified Powder, Materials Transactions, vol. 44, No. 7 (2003) pp. 1311-1315. (Year: 2003).*
Kakisawa et al. A New Powder Metallurgical Process for Upgrading Recycling of Fe—Cu Alloy. Materials Science Forum, Vosl. 426-432, pp. 4259-4264. 2003. (Year: 2003).*
JP H11-302787 machine translation (Year: 1999).*
JP H10-237584 machine translation (Year: 1998).*
JP H06-256802 machine translation (Year: 1994).*
JP H06-306403 machine translation (Year: 1994).*
Dec. 10, 2020, the Extended European Search Report issued by the European Patent Office in the corresponding European Patent Application No. 19774877.5.
J. L. Stewart et al., Influence of Thermal Aging on the Microstructure and Mechanical Behavior of Dual-Phase, Precipitation-Hardened, Powder Metallurgy Stainless Steels, Metallurgical and Materials Transactions A, Jan. 2012, pp. 124-135, vol. 43A.
S. K. Dhua et al., Effect of tempering temperatures on the mechanical properties and microstructures of HSLA-100 type copper-bearing steels, Materials Science and Engineering, 2001, pp. 197-210.
S. K. Ghosh et al., The influence of copper addition on microstructure and mechanical properties of thermomechanically processed microalloyed steels, Journal of Materials Science, 2009, pp. 580-590.
Nov. 9, 2021, Office Action issued by the Korean Intellectual Property Office in the corresponding Korean Patent Application No. 10-2020-7030247 with English language concise statement of relevance.
Aug. 18, 2020, Notification of Reasons for Refusal issued by the Japan Patent Office in the corresponding Japanese Patent Application No. 2019-531832 with English language Concise Statement of Relevance.
Jun. 4, 2019, International Search Report issued in the International Patent Application No. PCT/JP2019/012562.
Jan. 30, 2022, Office Action issued by the China National Intellectual Property Administration in the corresponding Chinese Patent Application No. 201980020238.1 with English language search report.
Feb. 2, 2021, Notification of Reasons for Refusal issued by the Japan Patent Office in the corresponding Japanese Patent Application No. 2019-531832 with English language concise statement of relevance.
Apr. 14, 2023, Communication pursuant to Article 94(3) EPC issued by the European Patent Office in the corresponding European Patent Application No. 19774877.5.
H. Kakisawa et al., Consolidation of Fe—Cu PM alloy for recycling of scrap iron, Transactions of the Materials Research Society of Japan, 2004, pp. 1781-1784.

* cited by examiner

ALLOYED STEEL POWDER FOR POWDER METALLURGY AND IRON-BASED MIXED POWDER FOR POWDER METALLURGY

TECHNICAL FIELD

This disclosure relates to an alloyed steel powder for powder metallurgy, and, in particular, to an alloyed steel powder for powder metallurgy having excellent compressibility from which sintered parts having high strength in an as-sintered state can be obtained. This disclosure also relates to an iron-based mixed powder for powder metallurgy containing the above-described alloyed steel powder for powder metallurgy.

BACKGROUND

Powder metallurgical technology enables manufacture of complicated-shape parts with dimensions very close to the products' shapes (i.e., near net shapes). This technology has been widely used in the manufacture of various parts, including automotive parts.

Recently, miniaturization and weight reduction of components such as automotive parts have been required, and there are increasing demands for further strengthening of sintered bodies produced by powder metallurgy. Also, with increasing demands for cost reduction in the world, the need for low-cost and high-quality alloyed steel powder for powder metallurgy is increasing in the field of powder metallurgy.

In most cases, strengthening of alloyed steel powder for powder metallurgy is achieved by adding Ni and many other alloying elements. Among them, Ni is widely used since it is an element that improves hardenability, that is less prone to solid solution strengthening, and that has good compressibility during forming. In addition, since Ni is not easily oxidized, there is no need to pay special attention to the heat treatment atmosphere when producing alloyed steel powder, and Ni is considered as an easy-to-handle element. This is another reason why Ni is widely used.

For example, JP 2010-529302 A (PTL 1) proposes an alloyed steel powder to which Ni, Mo, and Mn are added as alloying elements for the purpose of strengthening.

Further, JP 2013-204112 A (PTL 2) proposes the use of an alloyed steel powder containing alloying elements such as Cr, Mo, and Cu and mixed with a reduced amount of C.

JP 2013-508558 A (PTL 3) proposes a method of using an alloyed steel powder containing alloying elements such as Ni, Cr, Mo, and Mn and mixed with graphite and so on.

CITATION LIST

Patent Literature

PTL 1 JP 2010-529302 A
PTL 2 JP 2013-204112 A
PTL 3 JP 2013-508558 A

SUMMARY

Technical Problem

However, in addition to high cost, Ni has a disadvantage in that supply is unstable and price fluctuations are large. Therefore, the use of Ni is not suitable for cost-reduction, and there are increasing needs for alloyed steel powder that does not contain Ni.

Accordingly, it is conceivable to improve hardenability by adding an alloying element other than Ni. However, when adding an alloying element other than Ni, although hardenability is improved, the compressibility during forming of alloyed steel powder is reduced due to solid solution strengthening of the alloying element, presenting a dilemma that the strength of the sintered body does not increase.

Further, it has been proposed to use Cr or Mn as an alloying element other than Ni. However, since Cr and Mn are easily oxidized, oxidation occurs during sintering, leading to deterioration of the mechanical properties of the sintered body. Therefore, instead of using Cr or Mn that is easily oxidized, there has been demand for the use of an element that is difficult to oxidize.

Furthermore, in powder metallurgy, to manufacture high-strength parts, the powder is typically strengthened by being subjected to forming and sintering, followed by heat treatment. However, heat treatment performed twice, that is, heat treatment after sintering, causes an increase in production cost, and thus the above process can not meet the demand for cost reduction. Therefore, for further cost reduction, sintered bodies are required to have excellent strength in an as-sintered state without subjection to heat treatment.

For the above reasons, alloyed steel powder is required to satisfy all of the following requirements:

(1) not containing expensive Ni;
(2) having excellent compressibility;
(3) not containing elements susceptible to oxidation; and
(4) having excellent strength as a sintered body in an "as-sintered" state (without being subjected to further heat treatment).

The alloyed steel powder instances proposed in PTLs 1 to 3 contain Ni, and thus fail to satisfy the requirement (1). Further, the alloyed steel powder instances proposed in PTLs 1 to 3 contain an easily oxidized element, Cr or Mn, and thus fail to satisfy the requirement (3).

Furthermore, in PTL 2, the compressibility of the mixed powder during forming is improved by reducing the C content to a specific range. However, the method proposed in PTL 2 merely attempts to improve the compressibility of the mixed powder by reducing the amount of C to be mixed with the alloyed steel powder (such as graphite powder), and can not improve the compressibility of the alloyed steel powder itself. Therefore, in this method, it is impossible to satisfy the requirement (2). Further, in the method proposed in PTL 2, in order to compensate for strength decrease by reducing the C content, it is necessary to set the cooling rate during quenching after sintering to 2° C./s or higher. In order to perform such control of the cooling rate, it is necessary to remodel the manufacturing facility, resulting in increased manufacturing costs.

Further, in the method proposed in PTL 3, in order to improve the mechanical properties of a sintered body, it is necessary to perform additional heat treatment after sintering, such as carburizing, quenching, and tempering. Therefore, this method fails to satisfy the requirement (4).

Thus, alloyed steel powder for powder metallurgy that satisfies all of the requirements (1) to (4) has not yet been developed.

It would thus be helpful to provide an alloyed steel powder for powder metallurgy from which sintered parts that do not contain expensive Ni, or Cr or Mn susceptible to oxidation, that have excellent compressibility, and that have high strength in an as-sintered state can be obtained. It would also be helpful to provide an iron-based mixed powder for powder metallurgy that contains the above-described alloyed steel powder for powder metallurgy.

Solution to Problem

The present disclosure was completed to address the above-mentioned issues, and primary features thereof are described below.

1. An alloyed steel powder for powder metallurgy, comprising a chemical composition containing (consisting of) Cu: 1.0 mass % to 8.0 mass %, with the balance being Fe and inevitable impurities; and constituent particles in which Cu is present in an precipitated state with an average particle size of 10 nm or more.

2. The alloyed steel powder for powder metallurgy according to 1., wherein the chemical composition further contains Mo: 0.5 mass % to 2.0 mass %.

3. An iron-based mixed powder for powder metallurgy, comprising: the alloyed steel powder for powder metallurgy as recited in 1. or 2.; and a graphite powder in an amount of 0.2 mass % to 1.2 mass % with respect to a total amount of the iron-based mixed powder for powder metallurgy.

4. The iron-based mixed powder for powder metallurgy according to 3., further comprising a Cu powder in an amount of 0.5 mass % to 4.0 mass % with respect to a total amount of the iron-based mixed powder for powder metallurgy.

Advantageous Effect

The alloyed steel powder for powder metallurgy according to the present disclosure does not contain Ni that is an expensive alloying element, and thus can be produced at low cost. Further, since the alloyed steel powder for powder metallurgy disclosed herein does not contain an alloying element susceptible to oxidation, such as Cr or Mn, strength reduction of a sintered body due to oxidation of such alloying element does not occur. Furthermore, in addition to the hardenability improving effect obtained by containing Mo and Cu, the effect of improving the compressibility of the alloyed steel powder obtained by setting the average particle size of precipitated Cu to 10 nm or more enables production of a sintered body having excellent strength without performing heat treatment after sintering.

DETAILED DESCRIPTION

[Alloyed Steel Powder for Powder Metallurgy]

[Chemical Composition]

The following provides details of a method of carrying out the present disclosure. In the present disclosure, it is important that the alloyed steel powder for powder metallurgy (which may also be referred to simply as the "alloyed steel powder") has the above-described chemical composition. Thus, the reasons for limiting the chemical composition of the alloyed steel powder as stated above will be described first. As used herein, the "%" representations below relating to the chemical composition are in "mass %" unless stated otherwise.

Cu: 1.0% to 8.0%

The alloyed steel powder for powder metallurgy in one embodiment of the present disclosure contains Cu as an essential component. Cu is a hardenability-improving element and has an excellent property such that it is less likely to be oxidized than other elements such as Si, Cr, and Mn. Further, Cu is inexpensive as compared with Ni. In order to sufficiently exhibit the hardenability-improving effect, the Cu content is 1.0% or more, and preferably 2.0% or more. On the other hand, in manufacture of a sintered part, sintering is generally performed at about 1130° C., and at that time, as can be seen from the Fe—Cu phase diagram, Cu exceeding 8.0% is precipitated in the austenite phase. The Cu precipitates formed during sintering do not function effectively as a hardenability-improving element, but rather remain as a soft phase in the microstructure, leading to deterioration of mechanical properties. Therefore, the Cu content is 8.0% or less, and preferably 6.0% or less.

The alloyed steel powder for powder metallurgy in one embodiment of the present disclosure has a chemical composition that contains Cu in the above range, with the balance being Fe and inevitable impurities.

Mo: 0.5% to 2.0%

In another embodiment of the present disclosure, the chemical composition may further contain Mo. Mo, like Cu, is a hardenability-improving element, and has an excellent property in that it is less likely to be oxidized than other elements such as Si, Cr, and Mn. Further, Mo has a characteristic that a sufficient hardenability improving effect can be obtained by adding a small amount of Mo as compared with Ni.

When adding Mo, in order to sufficiently exhibit a hardenability-improving effect, the Mo content is 0.5% or more, and preferably 1.0% or more. On the other hand, if the Mo content exceeds 2.0%, the compressibility of the alloyed steel powder during pressing will decrease due to the high alloy content, causing a decrease in the density of the formed body. As a result, the increase in strength due to the improvement in hardenability is offset by the decrease in strength due to the decrease in density, resulting in a decrease in the strength of the sintered body. Therefore, the Mo content is 2.0% or less, and preferably 1.5% or less.

The alloyed steel powder for powder metallurgy in the above embodiment may have a chemical composition that contains Cu: 1.0% to 8.0% and Mo: 0.5% to 2.0%, with the balance being Fe and inevitable impurities.

The inevitable impurities are not particularly limited, and may include any elements. The inevitable impurities may include, for example, at least one selected from the group consisting of C, S, 0, N, Mn, and Cr. The contents of these elements as inevitable impurities are not particularly limited, yet preferably fall within the following ranges. By setting the contents of these impurity elements in the following ranges, it is possible to further improve the compressibility of the alloyed steel powder.

C: 0.02% or less

O: 0.3% or less, and more preferably 0.25% or less

N: 0.004% or less

S: 0.03% or less

Mn: 0.5% or less

Cr: 0.2% or less

[Cu Precipitates]

Average Particle Size: 10 nm or More

In the present disclosure, it is important that Cu present in a precipitated state 6 in the constituent particles constituting the alloyed steel powder for powder metallurgy (which may also be referred to simply as "Cu precipitates") has an average particle size of 10 nm or more. The reason for this limitation will be described below.

Cu precipitates have a characteristic that their crystal structures vary with size. It is known that when the particle size is less than 10 nm, Cu precipitates are coherently precipitated with respect to the matrix phase and mainly have a BCC (body-centered cubic) structure. The Cu precipitates thus formed have an extremely high ability of strengthening by precipitation due to the coherent strain field occurring between the matrix phase and the Cu precipitates. Therefore, if the average particle size of the Cu precipitates is less than 10 nm, the alloyed steel powder is hard and has extremely poor compressibility. On the other hand, when the particle size is more than 10 nm, the crystal structure of the Cu precipitates is an FCC (face-centered cubic) structure rather than a BCC structure. As a result, the consistency with the matrix phase is lost, and the coherent strain field also disappears. Further, since the Cu precipitates having an FCC structure is extremely soft, the effect of strengthening by precipitation is also small. Accordingly, the alloyed steel powder in which Cu precipitates having an average particle size of 10 nm or more are formed is soft despite containing Cu, and has a compressibility equivalent to that of an alloyed steel powder without containing Cu. Therefore, the average particle size of Cu precipitates is set to 10 nm or more.

On the other hand, the upper limit of the average particle size is not particularly limited. It is considered, however, that the average particle size does not exceed 1 μm even when Cu particles are coarsened by heat treatment or the like. Therefore, the average particle size may be 1 μm or less.

The average particle size of the Cu precipitates is mapped by conducting EDX (energy dispersive X-ray analysis) element mapping using STEM (scanning transmission electron microscope) to map the distribution state of Cu, and then performing image analysis considering a Cu concentrated part as a precipitate. The measurement method is as follows.

First, thin film samples for STEM observation are taken from the alloyed steel powder for powder metallurgy. Although there is no particular specification for the sampling, it is common to perform sampling using FIB (focused ion beam). Further, in order to perform mapping of Cu for each collected thin film sample, the mesh to which each thin film sample is attached is preferably made of a material other than Cu, for example, W, Mo, or Pt.

The STEM-EDX mapping is performed. Since fine Cu precipitates are particularly difficult to detect by mapping, a highly sensitive EDX detector is needed. Examples of the STEM device on which such a detector include mounted Talos F200X available from FEI. The observation region may be appropriately adjusted depending on the size of precipitated particles, it is preferable that at least 50 particles be included in the field of view. For example, if most of the precipitated particles have a particle size of 10 nm or less, a suitable analysis region is on the order of 180 nm x 180 nm. Preferably, such mapping is performed in at least two fields of view for each sample.

Then, the obtained element map is binarized to measure the particle size of the Cu precipitates. Examples of the software that can be used for the binarization of images include Image J (open source software). Through image interpretation, circle equivalent diameters d are obtained for the precipitated particles in the field of view, and integrated in ascending order of area. A circle equivalent diameter d for which the integrated area is 50% of all particles is obtained in each field of view, the results are averaged, and the average value is used as the average particle size of the Cu precipitates. In other words, the average particle size is a median size on an area basis.

Such an average particle size satisfying the above conditions may be obtained by, as will be described later, controlling the average cooling rate during finish-reduction and further performing heat treatment for causing Cu precipitates to coarsen after the finish-reduction in production of the alloyed steel powder.

[Iron-Based Mixed Powder for Powder Metallurgy]

The iron-based mixed powder for powder metallurgy in one embodiment of the present disclosure (which may also be referred to simply as the "mixed powder") contains the above-described alloyed steel powder for powder metallurgy and a graphite powder as an alloying powder. Further, the mixed powder in another embodiment contains the above-described alloyed steel powder for powder metallurgy, and a graphite powder and a Cu powder as alloying powders. Hereinafter, the components contained in the iron-based mixed powder for powder metallurgy will be described. In the following, the addition amount of each alloying powder contained in the mixed powder will be represented as the ratio (mass %) of the mass of the alloying powder to the mass of the entire mixed powder (excluding the lubricant) unless otherwise specified. In other words, the amount of each alloying powder added to the mixed powder is expressed by the ratio (mass %) of the mass of the alloying powder to the total mass of the alloyed steel powder and the alloying powder(s).

[Alloyed Steel Powder for Powder Metallurgy]

The iron-based mixed powder for powder metallurgy according to the present disclosure contains, as an essential component, the alloyed steel powder for powder metallurgy having the above-described chemical composition and Cu precipitates with the above-described average particle size. Therefore, the mixed powder contains Fe derived from the alloyed steel powder. As used herein, the term "iron-based" means that the Fe content (in mass %) defined as the ratio of the mass of Fe contained in the mixed powder to the mass of the entire mixed powder is 50% or more. The Fe content is preferably 80% or more, more preferably 85% or more, and even more preferably 90% or more. Fe contained in the mixed powder may all be derived from the alloyed steel powder.

[Graphite Powder]

Graphite Powder: 0.2% to 1.2%

C, which constitutes the graphite powder, further increases the strength of a sintered body by providing solid solution strengthening and a hardenability-improving effect when dissolved as a solute in Fe during sintering. When a graphite powder is used as an alloying powder, in order to obtain the above-described effect, the addition amount of the graphite powder is 0.2% or more, preferably 0.4% or more, and more preferably 0.5% or more. On the other hand, when the addition amount of the graphite powder exceeds 1.2%, the sintered body becomes hypereutectoid, forming a large number of cementite precipitates, which ends up reducing the strength of the sintered body. Therefore, when a graphite powder is used, the addition amount of the graphite powder is 1.2% or less, preferably 1.0% or less, and more preferably 0.8% or less.

The average particle size of the graphite powder is not particularly limited, yet is preferably 0.5 μm or more, and more preferably 1 μm or more.

The average particle size is preferably 50 μm or less, and more preferably 20 μm or less.

[Cu Powder]

Cu Powder: 0.5% to 4.0%

The iron-based mixed powder for powder metallurgy in one embodiment of the present disclosure may further optionally contain a Cu powder. A Cu powder has the effect of improving the hardenability, and accordingly increasing the strength of the sintered body. Further, a Cu powder is melted into liquid phase during sintering, and has the effect of causing particles of the alloyed steel powder to stick to each other. When a Cu powder is used as an alloying powder, in order to obtain the above-described effect, the addition amount of the Cu powder is preferably 0.5% or more, more preferably 0.7% or more, and more preferably 1.0% or more. On the other hand, when the addition amount of the Cu powder is more than 4.0%, the tensile strength of the sintered body is lowered by a reduction in the sintering density caused by the expansion of Cu. Therefore, when a Cu powder is used, the addition amount of the Cu powder is preferably 4.0% or less, more preferably 3.0% or less, and even more preferably 2.0% or less.

The average particle size of the Cu powder is not particularly limited, yet is preferably set to 0.5 μm or more, and more preferably 1 μm or more.

The average particle size is preferably 50 μm or less, and more preferably 20 μm or less.

In one embodiment of the present disclosure, the iron-based mixed powder for powder metallurgy may be made of the above-described alloyed steel powder and a graphite powder. In another embodiment, the iron-based mixed powder for powder metallurgy may be made of the above-described alloyed steel powder, a graphite powder, and a Cu powder.

[Lubricant]

In one embodiment, the iron-based mixed powder for powder metallurgy may further optionally contain a lubricant. By adding a lubricant, it is possible to facilitate removal of a formed body from the mold.

Any lubricant may be used without any particular limitation. The lubricant may be, for example, at least one selected from the group consisting of a fatty acid, a fatty acid amide, a fatty acid bisamide, and a metal soap. Among them, it is preferable to use a metal soap such as lithium stearate or zinc stearate, or an amide-based lubricant such as ethylene bisstearamide.

The addition amount of the lubricant is not particularly limited, yet from the viewpoint of further enhancing the addition effect of the lubricant, it is preferably 0.1 parts by mass or more, and more preferably 0.2 parts by mass or more, with respect to the total of 100 parts by mass of the alloyed steel powder and alloying powder(s). On the other hand, by setting the addition amount of the lubricant to 1.2 parts by mass or less with respect to the total of 100 parts by mass of the alloyed steel powder and alloying powder(s), it is possible to reduce the proportion of non-metals in the entire mixed powder, and further increase the strength of the sintered body. Therefore, the addition amount of the lubricant is preferably 1.2 parts by mass or less with respect to the total of 100 parts by mass of the alloyed steel powder and alloying powder(s).

In one embodiment of the present disclosure, the iron-based mixed powder for powder metallurgy may be made of the above-described alloyed steel powder, graphite powder, and lubricant. In another embodiment, the iron-based mixed powder for powder metallurgy may be made of the above-described alloyed steel powder, graphite powder, Cu powder, and lubricant.

[Method of Producing Alloyed Steel Powder]

Next, a method of producing an alloyed steel powder for powder metallurgy according to one embodiment of the present disclosure will be described.

The method of producing the alloyed steel powder for powder metallurgy according to the present disclosure is not particularly limited, and the alloyed steel powder may be produced in any way. However, the alloyed steel powder is preferably produced using an atomizing method. In other words, the alloyed steel powder for powder metallurgy according to the present disclosure is preferably an atomized powder. Thus, the following describes the production of the alloyed steel powder using an atomizing method.

[Atomization]

First, to prepare a molten steel having the above-described chemical composition, the molten steel is formed into a precursor powder (raw powder) using an atomizing method. As the atomizing method, it is possible to use any of a water atomizing method and a gas atomizing method, it is preferable to use a water atomizing method from the perspective of productivity. In other words, the alloyed steel powder for powder metallurgy according to the present disclosure is preferably a water-atomized powder.

[Drying and Classification]

Since the raw powder produced by the atomizing method contains a large amount of moisture, the raw powder is dehydrated through a filter cloth or the like and then dried. Then, classification is performed to remove coarse grains and foreign matter. The raw powder that has passed through a sieve having a sieve opening of about 180 μm (80 mesh) in the classification is used in the subsequent step.

[Finish-Reduction]

Then, the finish-reduction (heat treatment) is performed. Through the finish-reduction, decarburization, deoxidation, and denitrification of the alloyed steel powder are accomplished. The atmosphere for the finish-reduction is preferably an reducing atmosphere, and more preferably a hydrogen atmosphere. In this heat treatment, it is preferable that the temperature be raised, held at a predetermined soaking temperature in the soaking zone, and then lowered. The soaking temperature is preferably 800° C. to 1000° C. Below 800° C., the reduction of the alloyed steel powder is insufficient. On the other hand, above 1000° C., the sintering progresses excessively, making the crushing process following the finish-reduction difficult. Further, since the decarburization, deoxidation, and denitrification of the alloyed steel powder is accomplished sufficiently at 1000° C. or lower, it is preferable to set the soaking temperature to 800° C. to 1000° C. from the perspective of cost reduction.

Further, the cooling rate in the process of lowering the temperature in the finish-reduction is 20° C./min or lower, and preferably 10° C./min or lower. When the cooling rate is 20° C./min or lower, the average particle size of Cu precipitates in the alloyed steel powder after the finish-reduction can be adjusted to 10 nm or more.

[Grinding and Classification]

The alloyed steel powder after the finish-reduction is in a state where particles aggregate through the sintering. Therefore, in order to obtain a desired particle size, it is preferable to perform grinding and classification by sieving into 180 μm or less.

If the coarsening of Cu precipitates in the above finish-reduction step is insufficient, it is also possible to subject the alloyed steel powder after the finish-reduction to another heat treatment (coarsening heat treatment) in order to achieve further coarsening. The soaking temperature in the coarsening heat treatment must be kept at or below the transformation temperature since it is necessary to maintain the state in which Cu precipitates are formed. Since the transformation temperature varies somewhat depending on the components of the alloyed steel powder, it needs to be adjusted arbitrarily depending on the components. For example, in the case of a simple binary system of Fe—Cu or a simple ternary system of Fe—Cu—Mo, the soaking temperature is preferably lower than 900° C.

[Method of Producing Mixed Powder]

Furthermore, in production of the iron-based mixed powder for powder metallurgy, the alloyed steel powder obtained through the above procedure is optionally added and mixed with a graphite powder, a Cu powder, a lubricant, and so on.

[Method of Producing Sintered Body]

The alloyed steel powder and the mixed powder according to the present disclosure can be formed into a sintered body in any way without limitation to a particular method. Hereinafter, an exemplary method of producing a sintered body will be described.

First, powder is fed into a mold and pressed therein. At this point, the pressing force is preferably set to 400 MPa to 1000 MPa. When the pressing force is below 400 MPa, the density of the formed body is low, and the strength of the sintered body is reduced. When the pressing force is above 1000 MPa, the load on the mold is increased, the mold life is shortened, and the economic advantage is lost. The temperature during pressing preferably ranges from the room temperature (about 20° C.) to 160° C. Prior to the pressing, it is also possible to add a lubricant to the mixed powder for powder metallurgy. In this case, the final amount of the lubricant contained in the mixed powder for powder metallurgy to which the lubricant has been added is preferably 0.1 parts by mass to 1.2 parts by mass with respect to the total of 100 parts by mass of the alloyed steel powder and alloying powder(s).

The resulting formed body is then sintered. The sintering temperature is preferably 1100° C. to 1300° C. When the sintering temperature is below 1100° C., the sintering does not proceed sufficiently. On the other hand, the sintering proceeds sufficiently at or below 1300° C. Accordingly, a sintering temperature above 1300° C. leads to an increase in the production cost. The sintering time is preferably from 15 minutes to 50 minutes. A sintering time shorter than 15 minutes results in insufficient sintering. On the other hand, the sintering proceeds sufficiently in 50 minutes or less. Accordingly, a sintering time longer than 50 minutes causes a remarkable increase in cost. In the process of lowering the temperature after the sintering, it is preferable to perform cooling in the sintering furnace at a cooling rate of 20° C./min to 40° C./min. This is a normal cooling rate range in a conventional sintering furnace.

EXAMPLES

More detailed description is given below based on examples. The following examples merely represent preferred examples, and the present disclosure is not limited to these examples.

Example 1

The following experiments were conducted to confirm the compressibility-improving effect obtained by increasing the particle size of Cu precipitates. First, pre-alloyed steel powder (raw powder) samples having the chemical compositions listed in Tables 1 and 2 and containing Cu precipitates were prepared by a water atomizing method. Each of the resulting pre-alloyed steel powder samples was then subjected to finish-reduction to obtain an alloyed steel powder for powder metallurgy. In the finish-reduction, each sample was soaked at 950° C. in a hydrogen atmosphere, and then cooled at various rates to change the average particle size of Cu precipitates. However, the cooling rate was 20° C./min or lower in all examples.

The average particle size of Cu precipitates in each resulting alloyed steel powder for powder metallurgy was measured by the above-described method. The measurement results are listed in Tables 1 and 2.

Then, each resulting alloyed steel powder was mixed with ethylene bisamide (EBS) as a lubricant in an amount of 0.5 parts by mass with respect to 100 parts by mass of the alloyed steel powder, and then compressed at a compacting pressure of 686 MPa to obtain a formed body. Compressibility was evaluated by measuring the density of each obtained formed body. The measurement results are listed in Tables 1 and 2.

Pass/fail judgment was conducted as follows: those samples were judged as "passed" if the difference in the density of the formed body from the reference value was −0.05 Mg/m$^3$ or more with respect to an alloyed steel powder to which Cu was not added, or "failed" if the difference was smaller. The density of No. A1 in Table 1 and the density of No. B1 in Table 2 were respectively used as the reference values. As can be seen from the results in Tables 1 and 2, all of the alloyed steel powder samples satisfying the conditions of the present disclosure satisfied the acceptance criteria, and, despite the addition of Cu, exhibited compressibility comparable to alloyed steel powder without addition of Cu.

TABLE 1

| | Alloyed steel powder | | | | |
|---|---|---|---|---|---|
| | Chemical composition * (mass %) | | Average particle size of Cu precipitates | Formed body Density | |
| No. | Mo | Cu | (nm) | (Mg/m$^3$) | Remarks |
| A1 | — | — | — | 7.24 | Comparative Example |
| A2 | — | 0.5 | 4 | 7.16 | Comparative Example |
| A3 | — | 0.8 | 7 | 7.17 | Comparative Example |
| A4 | — | 1.0 | 11 | 7.19 | Example |
| A5 | — | 1.5 | 19 | 7.21 | Example |
| A6 | — | 3.0 | 37 | 7.22 | Example |
| A7 | — | 4.0 | 59 | 7.24 | Example |
| A8 | — | 6.0 | 78 | 7.25 | Example |
| A9 | — | 8.0 | 91 | 7.26 | Example |

* The balance is Fe and inevitable impurities.

TABLE 2

| | Alloyed steel powder | | | | |
|---|---|---|---|---|---|
| | Chemical composition * (mass %) | | Average particle size of Cu precipitates | Formed body Density | |
| No. | Mo | Cu | (nm) | (Mg/m$^3$) | Remarks |
| B1 | 1.0 | — | — | 7.15 | Comparative Example |
| B2 | 1.0 | 0.5 | 6 | 7.08 | Comparative Example |
| B3 | 1.0 | 0.8 | 9 | 7.09 | Comparative Example |
| B4 | 1.0 | 1.0 | 13 | 7.10 | Example |
| B5 | 1.0 | 1.5 | 21 | 7.12 | Example |
| B6 | 1.0 | 3.0 | 40 | 7.14 | Example |
| B7 | 1.0 | 4.0 | 67 | 7.17 | Example |
| B8 | 1.0 | 6.0 | 81 | 7.18 | Example |
| B9 | 1.0 | 8.0 | 93 | 7.19 | Example |

* The balance is Fe and inevitable impurities.

Example 2

Alloyed steel powder (pre-alloyed steel powder) samples having chemical compositions containing Cu and Mo in the amounts listed in Table 3, with the balance being Fe and inevitable impurities, were produced by a water atomizing method. Each resulting alloyed steel powder (water-atomized powder) sample was then subjected to finish-reduction to obtain an alloyed steel powder for powder metallurgy. In the finish-reduction, each sample was soaked at 950° C. in a hydrogen atmosphere and cooled at a rate of 10° C./min.

The average particle size of Cu precipitates in each resulting alloyed steel powder for powder metallurgy was measured by the above-described method. The measurement results are also listed in Table 3.

Then, each alloyed steel powder after the finish-reduction was added with a graphite powder as an alloying powder and ethylene bisstearamide (EBS) as a lubricant, and mixed while being heated at 140° C. in a rotary vane heating mixer to obtain an iron-based mixed powder for powder metallurgy. The addition amount of a graphite powder was 0.5 mass % in terms of the ratio of the mass of the graphite powder to the total mass of the alloyed steel powder and the graphite powder. Further, the addition amount of EBS was 0.5 parts by mass with respect to the total of 100 parts by mass of the alloyed steel powder and the alloying powder.

Each obtained iron-based mixed powder for powder metallurgy was subjected to forming at a compacting pressure of 686 MPa, and a ring-shaped formed body having an outer diameter of 38 mm, an inner diameter of 25 mm, and a thickness of 10 mm, and a flat formed body defined in JIS Z 2550 were obtained. As an indicator of the compressibility of the powder, the dimensions and weight of each resulting ring-shaped formed body was measured to calculate the density (forming density). The measurement results are listed in Table 3.

Then, each formed body was sintered under the conditions of 1130° C. for 20 minutes in an RX gas (propane-modified gas) atmosphere to obtain a sintered body, and the outer diameter, the inner diameter, the height, and the weight of the sintered body were measured to calculate the density (sintering density). The measurement results are listed in Table 3.

Furthermore, using each sintered body obtained by sintering the flat formed body as a test piece, the tensile strength of the sintered body was measured. The measurement results are listed in Table 3.

In this case, test specimens were judged as "passed" when the tensile strength was 800 MPa or more, or "failed" when the tensile strength was less than 800 MPa. As can be seen from the results in Table 3, in the examples satisfying the conditions of the present disclosure, the average particle size of Cu precipitates was adjusted to be 10 nm or more, with the result that each obtained sintered body had an increased forming density and a tensile strength as high as 800 MPa or more.

TABLE 3

| | Mixed powder | | | | | | | | | |
|---|---|---|---|---|---|---|---|---|---|---|
| | Alloyed steel powder | | | | Alloying powder | | | | | |
| | Chemical composition * (mass %) | | Cooling rate after final reduction | Average particle size of Cu precipitates | Addition amount (mass %) | | Formed body | Sintered body | | |
| No. | Mo | Cu | (° C./min) | (nm) | Graphite powder | Cu powder | Density ($Mg/m^3$) | Density ($Mg/m^3$) | Tensile strength (MPa) | Remarks |
| C1 | 0.3 | 3.0 | 10 | 35 | 0.5 | — | 7.14 | 7.11 | 683 | Comparative Example |
| C2 | 0.5 | 3.0 | 10 | 34 | 0.5 | — | 7.13 | 7.10 | 821 | Example |
| C3 | 1.0 | 3.0 | 10 | 36 | 0.5 | — | 7.11 | 7.08 | 913 | Example |
| C4 | 1.5 | 3.0 | 10 | 36 | 0.5 | — | 7.10 | 7.07 | 989 | Example |
| C5 | 2.0 | 3.0 | 10 | 34 | 0.5 | — | 7.07 | 7.04 | 884 | Example |
| C6 | 2.3 | 3.0 | 10 | 35 | 0.5 | — | 7.03 | 7.00 | 791 | Comparative Example |
| C7 | 1.5 | 0.5 | 10 | 6 | 0.5 | — | 7.03 | 7.01 | 796 | Comparative Example |
| C8 | 1.5 | 1.0 | 10 | 13 | 0.5 | — | 7.05 | 7.03 | 831 | Example |
| C9 | 1.5 | 2.0 | 10 | 23 | 0.5 | — | 7.08 | 7.05 | 921 | Example |
| C10 | 1.5 | 3.0 | 10 | 37 | 0.5 | — | 7.10 | 7.07 | 989 | Example |
| C11 | 1.5 | 4.0 | 10 | 59 | 0.5 | — | 7.12 | 7.09 | 964 | Example |
| C12 | 1.5 | 6.0 | 10 | 78 | 0.5 | — | 7.13 | 7.10 | 921 | Example |
| C13 | 1.5 | 8.0 | 10 | 91 | 0.5 | — | 7.15 | 7.12 | 879 | Example |
| C14 | 1.5 | 10.0 | 10 | 95 | 0.5 | — | 7.18 | 7.15 | 790 | Comparative Example |

* The balance is Fe and inevitable impurities.

Example 3

Alloyed steel powder samples, mixed powder samples, formed bodies, and sintered bodies were prepared under the same conditions as in Example 2 except that the cooling rate after the finish-reduction was changed, and were evaluated in the same manner as in Example 2. The production conditions and evaluation results are listed in Table 4.

As can be seen from the results in Table 4, in the examples satisfying the conditions of the present disclosure, the average particle size of Cu precipitates was adjusted to be 10 nm or more, with the result that each obtained sintered body had an increased forming density and a tensile strength as high as 800 MPa or more.

TABLE 4

| | Mixed powder | | | | | | | | | |
|---|---|---|---|---|---|---|---|---|---|---|
| | Alloyed steel powder | | | | Alloying powder | | | | | |
| | Chemical composition * (mass %) | | Cooling rate after final reduction | Average particle size of Cu precipitates | Addition amount (mass %) | | Formed body | Sintered body | | |
| No. | Mo | Cu | (° C./min) | (nm) | Graphite powder | Cu powder | Density ($Mg/m^3$) | Density ($Mg/m^3$) | Tensile strength (MPa) | Remarks |
| D1 | 1.5 | 3.0 | 30 | 6 | 0.5 | — | 7.03 | 7.00 | 732 | Comparative Example |
| D2 | 1.5 | 3.0 | 25 | 9 | 0.5 | — | 7.04 | 7.01 | 792 | Comparative Example |
| D3 | 1.5 | 3.0 | 20 | 12 | 0.5 | — | 7.05 | 7.02 | 852 | Example |
| D4 | 1.5 | 3.0 | 15 | 22 | 0.5 | — | 7.07 | 7.04 | 913 | Example |
| D5 | 1.5 | 3.0 | 10 | 40 | 0.5 | — | 7.10 | 7.07 | 989 | Example |
| D6 | 1.5 | 3.0 | 5 | 55 | 0.5 | — | 7.11 | 7.08 | 998 | Example |

* The balance is Fe and inevitable impurities.

Example 4

Alloyed steel powder samples, mixed powder samples, formed bodies, and sintered bodies were prepared under the same conditions as in Example 2 except that the addition amount of a Cu powder in the mixed powder was changed, and were evaluated in the same manner as in Example 2. The production conditions and evaluation results are listed in Table 5. The addition amount of a graphite powder in Table 5 represents the ratio of the mass of the graphite powder to the total mass of the alloyed steel powder and the alloying powder. The addition amount of a Cu powder in Table 5 represents the ratio of the mass of the Cu powder to the total mass of the alloyed steel powder and the alloying powder.

As can be seen from the results in Table 5, in the examples satisfying the conditions of the present disclosure, the average particle size of Cu precipitates was adjusted to be 10 nm or more, with the result that each obtained sintered body had an increased forming density and a tensile strength as high as 800 MPa or more.

TABLE 5

| | Mixed powder | | | | | | | | | |
|---|---|---|---|---|---|---|---|---|---|---|
| | Alloyed steel powder | | | | Alloying powder | | | | | |
| | Chemical composition * (mass %) | | Cooling rate after final reduction | Average particle size of Cu precipitates | Addition amount (mass %) | | Formed body | Sintered body | | |
| No. | Mo | Cu | (° C./min) | (nm) | Graphite powder | Cu powder | Density ($Mg/m^3$) | Density ($Mg/m^3$) | Tensile strength (MPa) | Remarks |
| E1 | 1.5 | 3.0 | 10 | 37 | 0.1 | — | 7.17 | 7.14 | 801 | Comparative Example |
| E2 | 1.5 | 3.0 | 10 | 37 | 0.2 | — | 7.14 | 7.12 | 821 | Example |
| E3 | 1.5 | 3.0 | 10 | 37 | 0.5 | — | 7.10 | 7.07 | 989 | Example |
| E4 | 1.5 | 3.0 | 10 | 37 | 0.8 | — | 7.10 | 7.07 | 963 | Example |
| E5 | 1.5 | 3.0 | 10 | 37 | 1.0 | — | 7.09 | 7.06 | 902 | Example |
| E6 | 1.5 | 3.0 | 10 | 37 | 1.2 | — | 7.08 | 7.05 | 851 | Example |
| E7 | 1.5 | 3.0 | 10 | 37 | 1.5 | — | 7.07 | 7.04 | 795 | Comparative Example |
| E8 | 1.5 | 3.0 | 10 | 37 | 0.5 | — | 7.10 | 7.07 | 989 | Example |
| E9 | 1.5 | 3.0 | 10 | 37 | 0.5 | 0.5 | 7.11 | 7.07 | 1024 | Example |
| E10 | 1.5 | 3.0 | 10 | 37 | 0.5 | 1.0 | 7.11 | 7.07 | 1081 | Example |
| E11 | 1.5 | 3.0 | 10 | 37 | 0.5 | 2.0 | 7.12 | 7.06 | 1135 | Example |
| E12 | 1.5 | 3.0 | 10 | 37 | 0.5 | 3.0 | 7.13 | 7.06 | 1118 | Example |
| E13 | 1.5 | 3.0 | 10 | 37 | 0.5 | 4.0 | 7.14 | 7.06 | 1050 | Example |
| E14 | 1.5 | 3.0 | 10 | 37 | 0.5 | 5.0 | 7.15 | 7.05 | 980 | Example |

* The balance is Fe and inevitable impurities.

The invention claimed is:

1. An alloy powder for powder metallurgy, comprising a chemical composition consisting of Cu: 1.0 mass % to 8.0 mass % and Mo: 1.0 mass % to 2.0 mass %, with the balance being Fe and inevitable impurities, where the contents of C, O, N, S, Mn, and Cr as the inevitable impurities satisfy the following conditions, C: 0.02 mass % or less, O: 0.3 mass % or less, N: 0.004 mass % or less, S:0.03 mass % or less, Mn:

0.5 mass % or less, and Cr: 0.2 mass % or less; and constituent particles in which Cu is present in a precipitated state with an average particle size of 22 nm or more.

2. An iron-based mixed powder for powder metallurgy, comprising:

the alloy powder for powder metallurgy as recited in claim 1; and a graphite powder in an amount of 0.2 mass % to 1.2 mass % with respect to a total amount of the iron-based mixed powder for powder metallurgy.

3. The iron-based mixed powder for powder metallurgy according to claim 2, further comprising a Cu powder in an amount of 0.5 mass % to 4.0 mass % with respect to a total amount of the iron-based mixed powder for powder metallurgy.

* * * * *